US006786161B2

(12) United States Patent
Fischer

(10) Patent No.: US 6,786,161 B2
(45) Date of Patent: Sep. 7, 2004

(54) TABLE WITH MULTIPLE HEIGHT ADJUSTABLE STATIONS

(75) Inventor: Randall Fischer, Middletown, NY (US)

(73) Assignee: Center for Discovery, Harris, NY (US)

( * ) Notice: Subject to any disclaimer, the term of this patent is extended or adjusted under 35 U.S.C. 154(b) by 59 days.

(21) Appl. No.: 10/125,197

(22) Filed: Apr. 18, 2002

(65) Prior Publication Data

US 2003/0196573 A1 Oct. 23, 2003

(51) Int. Cl.[7] ..... A47B 37/00
(52) U.S. Cl. ..... 108/50.01; 108/64; 108/59
(58) Field of Search ..... 108/1, 3, 106, 108/108, 59, 69, 64, 50.01, 50.02; 312/195, 196, 197

(56) References Cited

U.S. PATENT DOCUMENTS

| | | | | |
|---|---|---|---|---|
| 744,888 | * | 11/1903 | Widman et al. | 108/32 |
| 1,077,826 | | 11/1913 | Frisina | |
| 2,492,139 | | 12/1949 | Eliason | 311/66 |
| 3,124,084 | | 3/1964 | Fuller et al. | 108/64 |
| 3,696,760 | * | 10/1972 | Riley | 108/32 |
| 3,920,299 | * | 11/1975 | Propst et al. | 312/209 |
| 4,248,477 | * | 2/1981 | Netters | 297/135 |
| 4,836,114 | * | 6/1989 | Cohen et al. | 108/77 |
| 4,917,436 | | 4/1990 | Thom | 297/157 |
| 5,375,514 | * | 12/1994 | Dann, Jr. | 100/145 |
| 5,410,971 | | 5/1995 | Golden et al. | 108/6 |
| D371,687 | | 7/1996 | Sims | D6/423 |
| 6,267,064 | * | 7/2001 | Ostertag et al. | 108/50.02 |
| 6,332,407 | * | 12/2001 | Vardaro | 108/50.01 |

FOREIGN PATENT DOCUMENTS

| | | | |
|---|---|---|---|
| EP | 94304109.5 | 8/1994 | A47B/87/00 |

* cited by examiner

*Primary Examiner*—Jose V. Chen
(74) *Attorney, Agent, or Firm*—Sandra M. Kotin

(57) ABSTRACT

A table having multiple stations arranged about a central stationary table top. The stations are independently vertically adjustable to accommodate the individual needs of the users. Adjustment mechanisms are utilized to independently adjust the height of each station and are easily operated by persons with a wide range of physical capabilities. More than one adjustment mechanism may be utilized. There can be a minimum of two stations but the dimensions and shape of the table top may be chosen to enable any desired number of stations. The use of a central stationary table top with stations arranged thereabout provides for a common area on which to place shared items and materials. This table encourages interaction among the users while enabling each to adjust his or her station to an exact table height as needed. The stations may also have tilt capabilities to further accommodate the needs of the users.

20 Claims, 6 Drawing Sheets

TABLE WITH MULTIPLE HEIGHT ADJUSTABLE STATIONS

FIELD OF THE INVENTION

The instant invention relates to tables, and more particularly to tables with multiple stations each of which is independently height adjustable.

BACKGROUND OF THE INVENTION

There have been a variety of tray assemblies, tables and adjustable stands or workstations designed for use by persons of varying sizes and statures and for persons with a wide variety of needs. Workstations have also been designed to accommodate persons with disabilities and persons using wheelchairs and other special seating arrangements. Such trays, tables and workstations can be used when eating, working or performing a variety of tasks. One such workstation is taught by Golden et al. in U.S. Pat. No. 5,410,971. The workstation can be used as a desk or other work place because the work surface is tiltably mounted to a frame having pivot arms and gas cylinders which enable the entire work surface to move laterally as well as vertically.

A problem arises when two or more persons wish to eat or work together, especially if they share various items. It is often difficult to move their stands, workstations or trays close enough to a table to make it practical or advisable to do so. The prior art has not directly addressed this problem though some of the prior art may be pertinent.

U.S. design Pat. No. Des. 371,687 to Sims discloses a desk or worktable having a two section work surface. One surface is fixed in height and the other can be vertically adjusted by means of a hand cranking mechanism.

U.S. Pat. No. 1,077,826 to Frisina discloses an extension table having a removable top and a compartment within the table body for storing a series of round leaves. Each leaf has a hinged connection to a slot within the compartment. A spring beneath the leaves pushes them upward as each is set and locked in place. When all of the leaves are locked in position, the table top can be replaced in the center resulting in six circular leaves extending outwardly from the central table top. All of the leaves are at the same level as the table top, but they appear to form separate stations. Eliason in U.S. Pat. No. 2,492,139 teaches a round extension table with a square center and four leaves shaped such that when placed between the outer rounded segments and square center result in a larger circular table. All parts of the extended table are at the same level when properly positioned Fuller et al. in U.S. Pat. No. 3,124,084 teaches a rotatable circular file surrounded by an annular circular table surface. One or more desk units can be attached to the table surface such that they each radiate outwardly from separate positions. The desks can be independently moved to any position around the circular table. The desks are curved at one edge so they closely abut the circular table, but all surfaces are at the same height.

A picnic table with wheelchair access is taught by Thom in U.S. Pat. No. 4,917,436. The table is constructed of wood and has an elevated rotatable central portion that operates as a lazy susan. There is a continuous bench made up of several segments supported by struts which are attached to the table framework.

One or more of the segments can be removed to provide wheelchair access to the table. A separate table extension can be affixed to the table at the site of the wheelchair opening, but this extension is at the same level as the table top.

A European patent application No. 94304109.5 to Ball et al. discloses a system of mobile tables that fit together to form a larger table. Each unit is on wheels for ease of movement and the table tops abut so that one continuous surface results when they are placed together. The inner edge of each table is curved so that t he grouping may have a circular central opening. The tables can be placed around a post unit holding various electrical, communication, computer or other such systems. The individual tables can be arranged in several different configurations. All of the table tops are at the same level.

The prior art does not disclose a single table that can accommodate several persons with different needs so that they can eat or work together, each at his or her own comfortable table height. The prior art does not disclose a multistation table where each station is independently height adjustable and where the adjustments can be easily accomplished by able bodied persons of all ages as well as persons with different capabilities or limitations.

BRIEF SUMMARY OF THE INVENTION

The instant invention provides a table having multiple stations, each of which is independently height adjustable without the necessity of tools of any kind.

It is an object of the instant invention to provide a table having at least two stations, each of which can be independently adjusted as to height to accommodate the individual needs of the users.

It is another object of the instant invention to have a multi-station table which can be utilized for a wide variety of different activities.

A further object of the instant invention is to have a multi-station table having stations that are easily adjustable by persons with different physical capabilities or limitations.

A still further object of the instant invention is to provide a multi-station table that enables persons with different disabilities and different needs to work, eat or participate in a variety of other activities together.

Another object of the instant invention is to provide a multi-station table having stations that are tiltable to meet special needs of the users.

A further object of the instant invention is to provide a table having a stationery portion for the placement of commonly used items as well as multiple height adjustable stations to accommodate individual needs.

Another object of the instant invention is to provide a table that is sized to accommodate both a pediatric and an adult population.

A further object of the instant invention is to provide a single table that can accommodate the needs of children from pre-school through high school, adults, senior citizens and persons with disabilities.

A still further object of the present invention is to provide a table that meets all of the needs of the users and is also esthetically pleasing.

The instant invention is a table for use by at least two persons, each of whom has different needs with respect to the height of the table. The table comprises a frame for placement on a supporting surface. There are at least two stations having substantially horizontal surfaces affixed to the frame. The stations are capable of being vertically adjusted and there are means to vertically adjust each station.

A table for use by at least two persons, each of whom has different needs. The table comprises a table top oriented horizontally and support means to which the table top is attached and for the support of the table on a horizontal surface. There are at least two stations capable of independent vertical movement and connecting means cooperating between the table top and each of the stations. The connecting means enable the stations to be attached to the table top and further to enable the stations to be vertically adjusted with respect to the table top. Each state can be vertically adjusted to accommodate the individual needs of the user.

A multi-station table for use by persons having different physical requirements while enabling their participation in communal activities. The table comprises a table top of generally polygonal shape with side edges. There is a support means for supporting the table top on a horizontal surface, a plurality of stations each having an outer edge and an inner edge, the inner edge of which is disposed substantially in contiguous relationship to one of the side edges of the table top and a plurality of pivotally segmented connecting means each cooperating between the table top and one of the stations to connect the station to the table top and additionally to enable the station to be vertically adjusted. There is also a control means in cooperation with each of the connecting means to control the vertical adjustment of the stations so that each person can vertically adjust the station at which he or she is seated in order to accommodate his or her individual needs while participating with the other persons similarly seated in the communal activities.

Other features and advantages of the invention will be seen from the following description and drawings.

DETAILED DESCRIPTION OF THE INVENTION

The multi-station table of the instant invention may be used as a dining table or a school room table. It may also be used for accessing computers, participating in different therapies or for a variety of work or recreational activities. Many more and varied uses may certainly be possible. The preferred embodiment may be designed for use by groups of persons of various sizes, various ages from very young children to adult, as well as groups ranging from the able bodied to persons with various disabilities and limitations.

The table may be made to accommodate at least two stations and may be designed to fulfill spatial and/or various other requirements. The table may consist of a simple frame or support with adjustable stations each of which may be attached directly to the frame. There may be a central table top attached to the frame with stations attached to the table top, to the frame, or a combination of the two forms of attachment.

Figure 1:
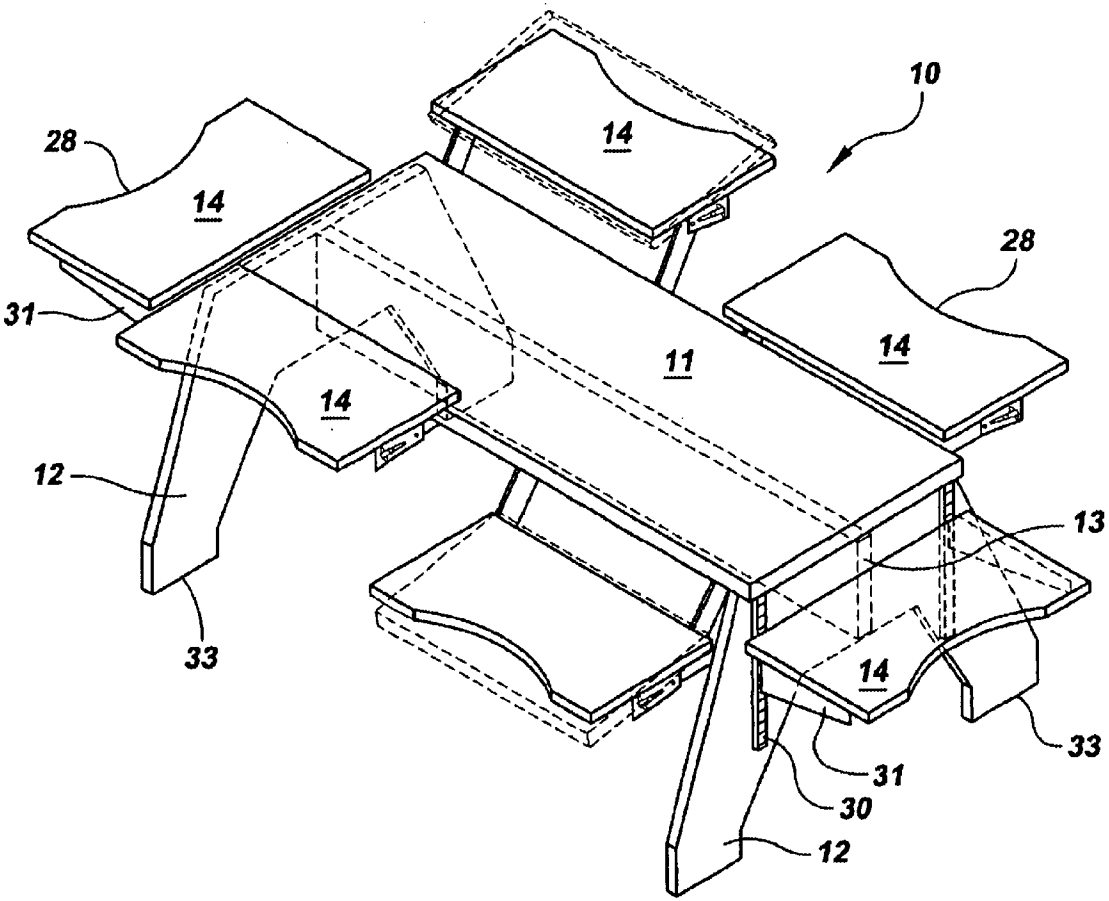
FIG. 1 is a perspective view of the table of the instant invention showing each of the six stations at different elevations.

The preferred embodiment of the multi-station table 10 may be seen in FIG. 1. The table 10 may have a central table top 11 that may be generally rectangular in shape. The table top 11 may be supported at its opposing ends by two substantially U-shaped stanchions 12 that may be of fixed height. The table top may also rest on a strut 13 that may run longitudinally beneath the table top 11 and may be attached at each end to one of the stanchions 12. There may be six individual stations 14, two situated at each side of the table top 11 and one situated at each end. The use of two stanchions 12 connected by a strut, the trestle support, may be preferable to other support means because it provides little interference with a wide variety of chairs or with wheelchair access to the table while permitting the vertically adjustable stations to be placed on all four sides of the table 10.

Figure 2:
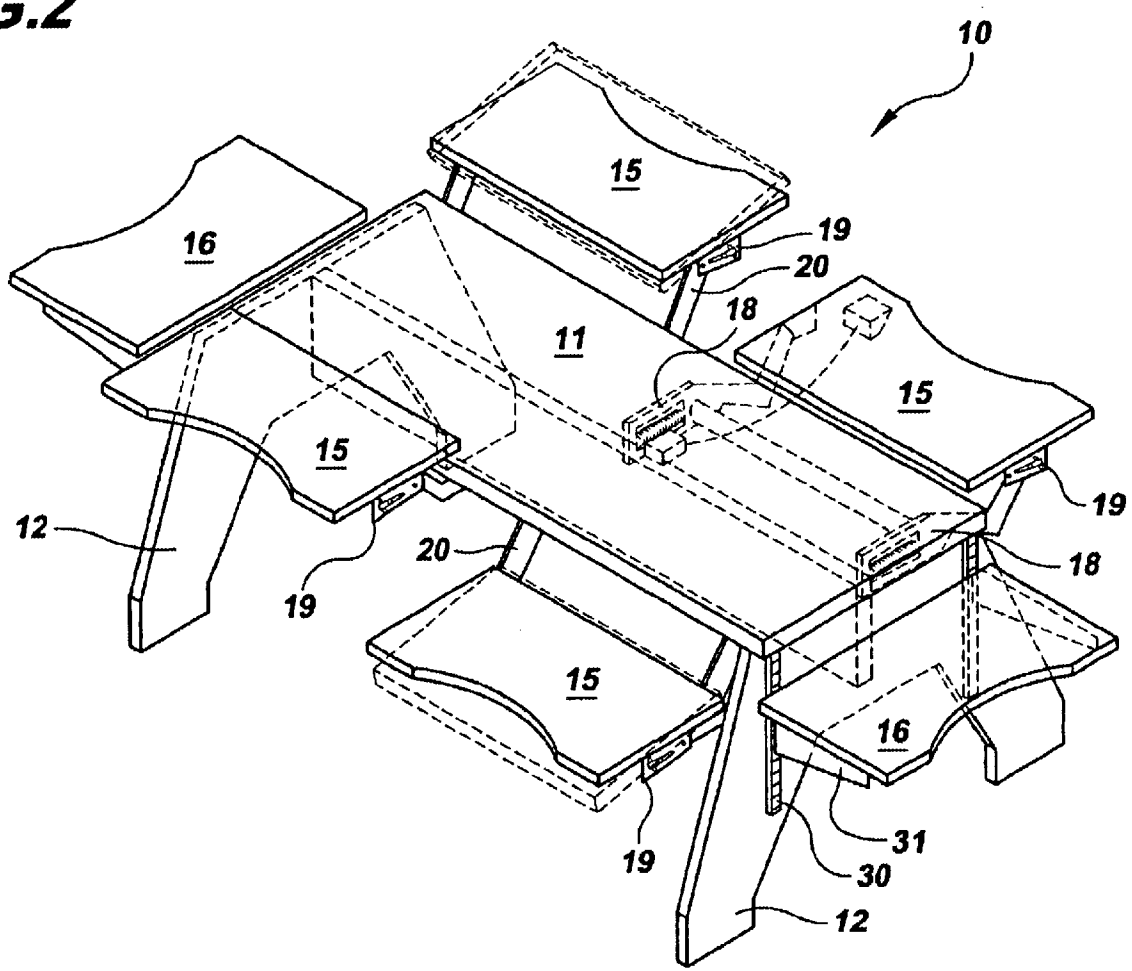
FIG. 2 is perspective view of the table of FIG. 1 with additional structural detailing.

The six stations 14 may all be height adjustable by means of the same mechanism, or the four side stations 15 may be adjusted by one type of mechanism and the two end stations 16 may be adjusted by another mechanism. (FIGS. 1, 2 and 3) Other combinations may be possible according to preference or structural limitations. Ideally, the stations should be easily adjustable by an able bodied person as well as a person with disabilities and without the need for tools of any kind. Two types of adjustment means have been used in the preferred embodiment and are illustrated and described herein.

Figure 4:
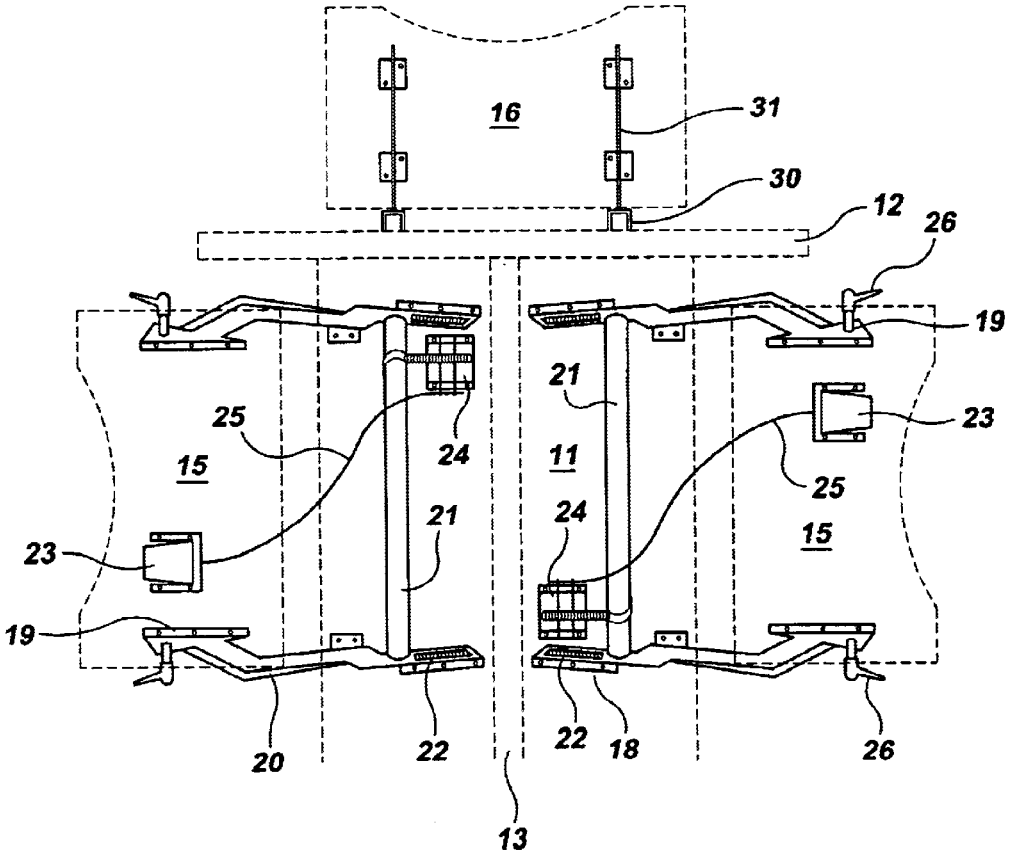
FIG. 4 is a plan view of the underside of one end of the table of the instant invention.
Figure 5:
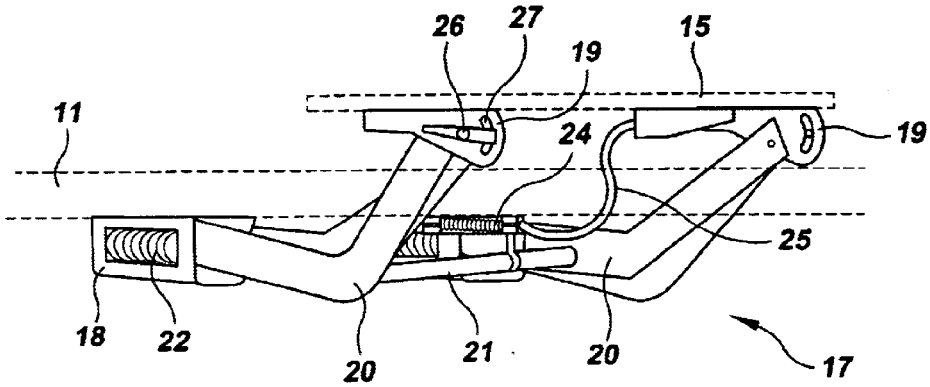
FIG. 5 is a perspective view of the lifting mechanism.

The four side stations 15 may be adjusted by means of a control system 17 (FIGS. 4 and 5) such as the Position Mate (trademark) Work Surface Control Systems (model number WN-18520–29 in the catalogue of Baer Supply Company, 2000, 909 Forest Edge Drive, Vernon Hills, Ill. 60061–3149) manufactured by the Weber Knapp Company.

The side stations 15 may be connected to the table top 11 by a control system 17 which may consist of two anchor portions 18, two lift portions 19 and two lift arms 20. The two anchor portions 18 may be attached at points on the underside of the table top 11 and the two lift portions 19 may be attached on each side of the underside of the side station 15. The lift arm 20 may cooperate with each set of the attached portions with a lift arm strut 21 connecting the two lift arms 20 and providing additional support to the system. Tension may be provided by a spring 22 situated within each of the anchor portions 18. A tension control 24 may cooperate with the spring 22 on one side only. The control system may be easily operable by means of a paddle release 23 that is merely squeezed to alter the height of the side station 15. A Bowden cable 25 may extend from the paddle release 23 to the tension control 24. See FIG. 4.

In addition to being height adjustable, the side stations 15 may also be tilted. The tilt may be made possible by a tilt lever 26 found on each lift portion 19 and which may cooperate with a curved slot 27 in the side of each lift portion 19. The side stations 15 may be tilted up to 15° away from the user, arc C-D in FIG. 3, and up to 9° toward the user, arc A-B in FIG. 3. The tilt may be advantageous to accommodate special needs or for ergonomic reasons such as when a keyboard is to be used.

This control system 17 may easily position the workstation 15 to an exact and comfortable height as needed by the user. The change in position may be accomplished with the paddle release 23 which requires minimal dexterity to operate. The workstation may also be tilted by means of the control system 17 tilt lever 26 to a desired angle, as noted above. The lift range of the control system 17 may be 12.75 inches (32.4 cm) which may provide a height adjustment of 7 inches (17.8 cm) above the level of the table top 11 and 5.75 inches (14.6 cm) below the level of the table top 11. The stations 14 may have a concavity 28 along their outer edges to enable the user to be closer to the table top 11 and to provide additional shoulder girdle support and arm support as well as more useful surface area for the user.

The two end stations 16 may be supported in a different manner. Height adjustment may be accomplished by means of two slotted standards 30 affixed to each stanchion 14 and two brackets 31 affixed to each end station 16. The brackets 31 may have flanges that may cooperate with the slots in the standards 30 and enable the elevation of the end stations 16 to be changed as needed. The particular standards and brackets used in the preferred embodiment may be the Reeve Store Equipment Co. RV-766 Series Heavy Duty Locking bracket model RV-766ZC and RV-700 Series Heavy Duty standard model RV-700ZC (Baer Supply Company catalog as noted above). Such standards and brackets may be commonly used in bookcases, shelf systems and the like. This support system may require more effort to effect a change in height than the control system 17, and may also require any materials that may have been placed on the end station 16 to be removed before the change in height may be made. However, this system may be chosen to keep the size of the table 10 to proportions suitable for six users while providing easy access to items on the central table top 11 and free wheel chair access to all stations 14.

Figure 3:
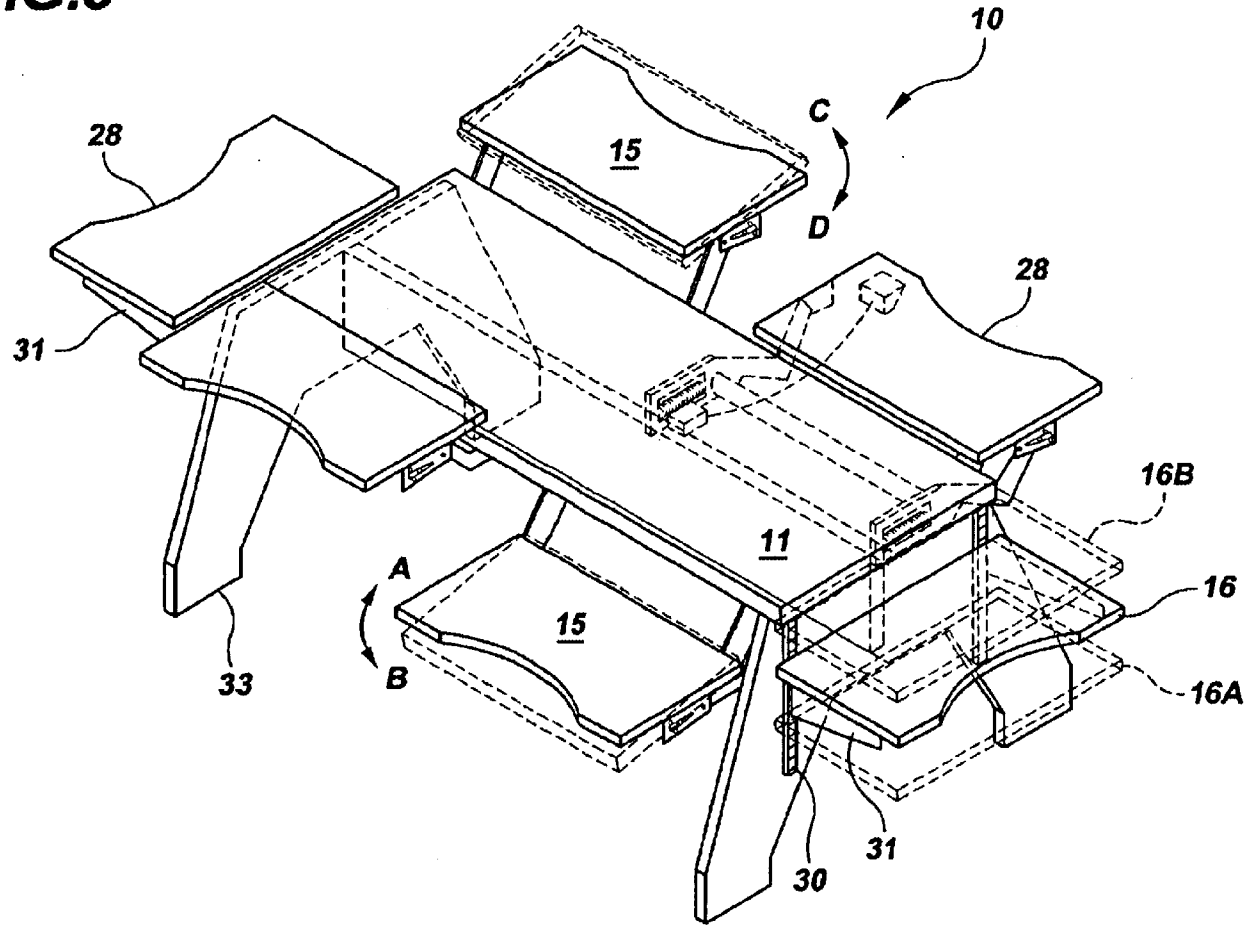
FIG. 3 is a perspective view of the table of FIG. 1 emphasizing the different levels of the end station.

To alter the height of an end station 16 the sides may be grasped with two hands and the end station 16 lifted until the flange portions of the two brackets 31 are removed from the slots of the standards 30. The end station 16 may thereafter be moved to the desired height and the flanges of the brackets 31 reinserted in the slots of the standards 30 such that the end station 16 may be securely seated. FIG. 3 may show an end station 16 situated below the level of the table top 11, in a position 16B level with the height of the table top 11 and in another lowered position 16A below the table top 11 and below the level of station 16. Movable stations using the standard and bracket system cannot be raised above the level of the table top 11 in the specific design illustrated. Other accommodations may be made in the design of the table to enable such a station to be raised above table top level and are not illustrated herein.

The particular choice of the combination of two adjustment systems may be dictated by the dimensions chosen for the table 10 and the number of stations 14 desired. The choice of six stations 14 may permit considerable interaction among users and also make sharing of common utensils and/or service items to be practical and within the reach of all. The preferred embodiment may have a table top 11 measuring 66 in (168 cm) long and 25.25 in (64 cm) wide which may comfortably accommodate six stations 14 each measuring 28.625 in (73 cm) wide and 16 in (41 cm) deep, with all of the stations 14 reasonably close together.

Each U-shaped stanchion 12 may be 27 in (69 cm) high. The upper edge 32 may be 25 in (63.5 cm) wide so that it may just fit under the table top 11 and may provide maximum support therefor. The width of the stanchion leg 33, the portion that rests on the floor, may be 7 in (18 cm). The inside U-shaped opening or middle portion of the stanchion 12 may be 17.75 in (45 cm) high. The overall width, or floor width of the stanchion 12, may be 42 in (107 cm) and may provide a very stable base for the table 10. The strut 13 may be 62 in (158 cm) long and 10 in (25 cm) high. All parts may be made of wood boards that may be 1.5 in (3.8 cm) in thickness. All surfaces may be covered with plastic laminate to provide a pleasing appearance and easy maintenance.

The placement of the stanchions 12 close to the ends of the table top 11 may permit the attachment of the anchor portions 18 of two control systems 17 as well as easy access without interference for two wheel chairs on each side of the table 10. The overhang remaining at each end of the table top 11 may be only 2 in (5 cm) which would not be sufficient to permit the installation of the control system 17 which may require at least 11 in (28 cm) clearance for proper installation. (See FIGS. 2 and 3) For this reason the standard 30 and bracket 31 system may be used for the height adjustment of the end stations 16.

The table top 11 may be made longer by at least 22 in (56 cm), 11 in (28 cm) at each end, to accommodate the installation of a control system 17 at each end. This may result in the users seated at the ends of the table 10 to be too far from the users seated on the sides of the table 10 to make the exchange and use of common items practical without necessitating additional modifications. The present arrangement may provide sufficient space for each station while keeping the overall dimensions as compact as possible.

A drawback of the system utilizing the standards 30 and brackets 31 may be the limitations of the ease of adjustment for the users at the end stations 16. For some users the assistance of others may be required. However, this system may permit all of users at the table 10 to be close enough to each other to exchange and share items. As an example, when used as a dining table, items such as salt and pepper shakers, sugar, cream, condiments and family style platters of food may easily be passed from one person to the other, even considering a limited mobility if some or all of the users are seated in wheel chairs, have other disabilities or have limited upper body mobility. When used for other activities, the table 10 may permit items such as scissors, adhesives, measuring tools or various paint pigments to be easily shared.

Future refinements of available control systems or new developments in such systems may make it possible for this general form of control system to be used at all stations while maintaining the ease of adjustment of the control system 17 described above and the close proximity of the stations to each other. Pneumatic, electric and/or a variety of mechanical systems may also be utilized in the design of such multi-station tables. The particular height adjustment system utilized may be an individual design choice and the instant invention may not be limited by the two systems described herein.

Figure 7:
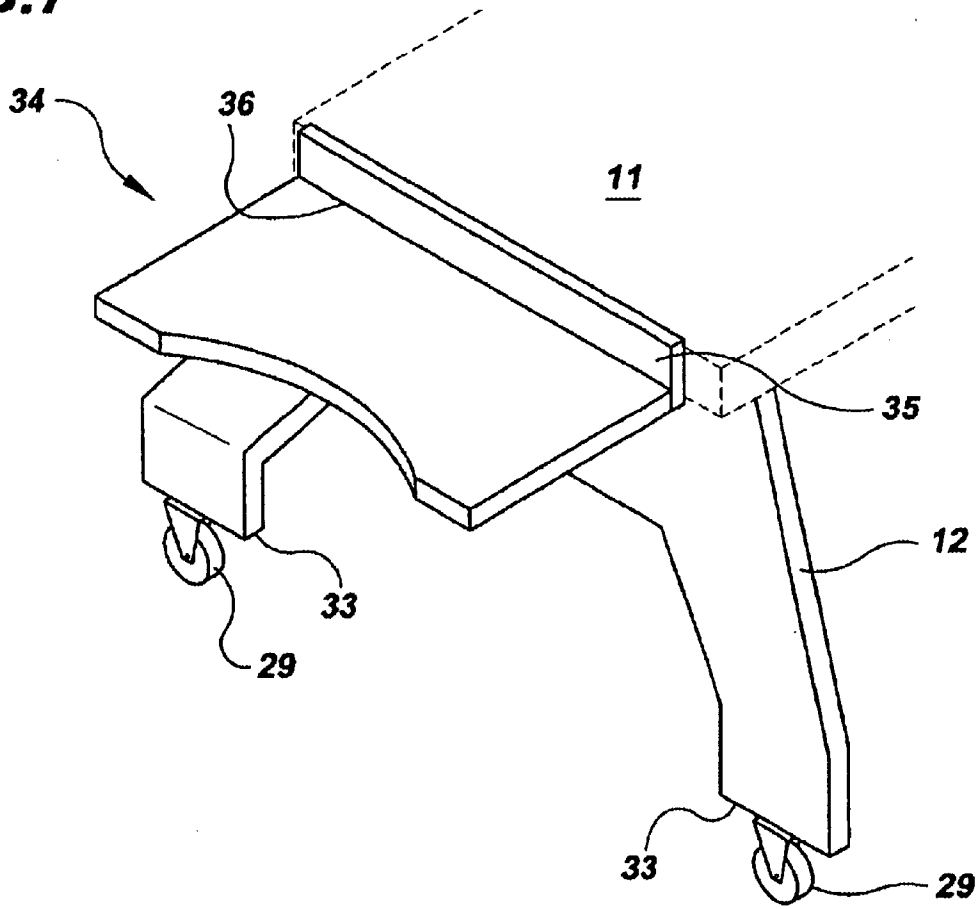
FIG. 7 is a perspective view one end of the table with an alternate station.

The table 10 may be quite heavy and difficult to move from place to place. To make moving the table 10 easier, casters 29 may be affixed to the bottom of the stanchion legs 33. (FIG. 7) The casters 29 may have locks to insure that no movement of the table 10 is possible once the table 10 is placed in a desired location. The dimensions of the stanchions 12 may be adjusted accordingly if casters 29 are attached so as to maintain the table top 11 at the desired height.

Each station may rarely be at the same level as the table top 11, and therefore there may be a tendency for objects to be pushed over the back edge 36 of the station, the edge farthest from the user. To avoid this possibility, an alternative station 34 may be utilized. This alternative station 34 may have a raised lip 35 running along the entire back edge 36 of the station 34. The lip 35 may not interfere with the operation of the station 34 but may insure that objects cannot be pushed off the back edge 36 of the station 35 when being removed from and replaced on the table top 11.

Figure 6:
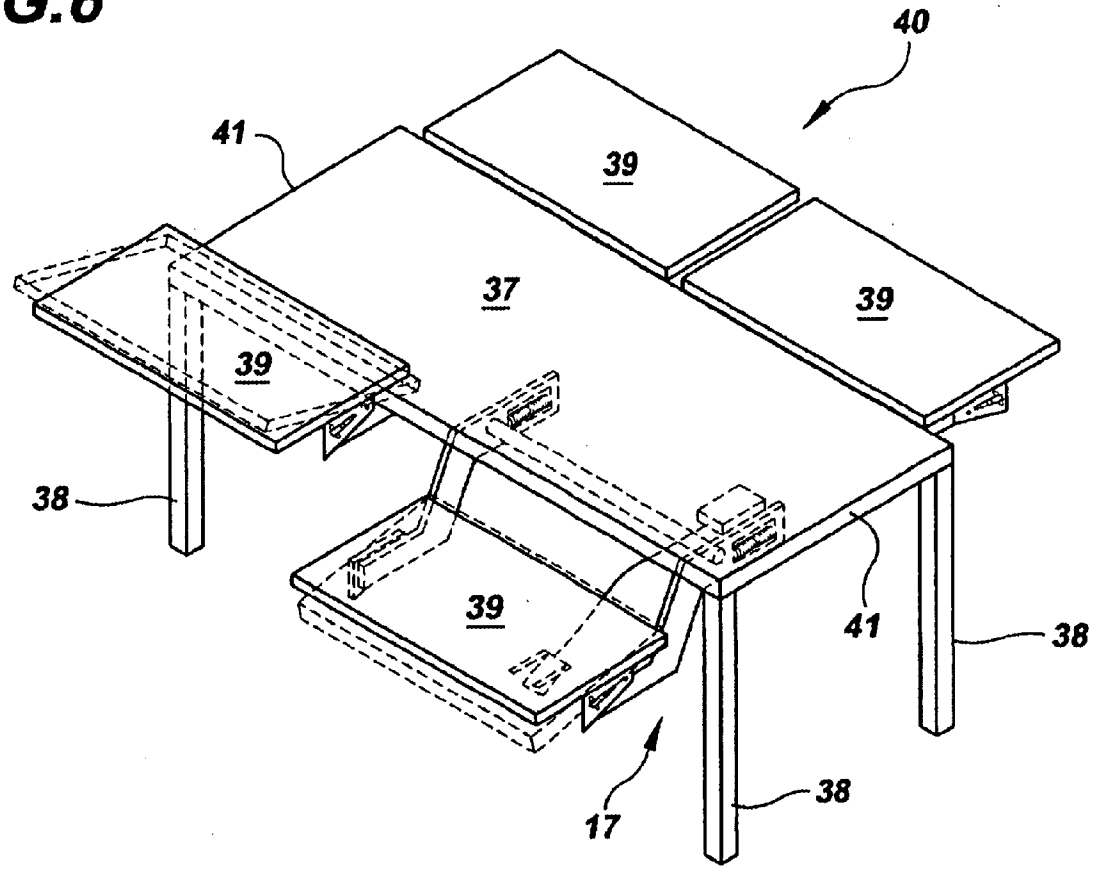
FIG. 6 is a perspective view of another embodiment of the instant invention.

The choice of the U-shaped stanchions 12 is only one of many design choices for the support of the table 10 of the instant invention. The more conventional table top 37 supported on four legs 38 may also be used, but may be more limiting. This may be seen in the second embodiment 40 of the instant invention illustrated in FIG. 6. This embodiment 40 may also be of any desired dimensions, but again, the stations 39 should be close enough to enable the users to share materials. With this in mind, it may not be possible to have stations at the ends 41 of the table 40. The table legs 38 may be situated at the corners of the table top 37 to provide the best stability and sufficient room for the installation of the anchor portions 18 of the control system 17. There may be no surface on which to anchor the standards 30 and brackets 31 of the "book case" system. The addition of a vertical board at each end 41 of the table 40 for attachment of the standards 30 may not present an esthetically pleasing result. To accommodate end stations utilizing the control system 17, the table top 37 would have to be extended at least 11 in (28 cm) on each end 41 placing the users at the end stations farther from the users at the side stations and may make sharing of materials more difficult for persons with limited reach capabilities. Additionally, if there are no end stations, there may be more than two stations situated on each side of the table. A table of the type shown in FIG. 6 may have three stations on each side and still exhibit the overall dimensions of the preferred embodiment (table 10).

The instant invention may just as easily be practiced using a polygonal shaped table top with a central support and stations disposed at each edge. Again, the dimensions and structural limitations may be dictated by the type of adjustment mechanism selected.

While two embodiments of the instant invention have been illustrated and described in detail, it is to be understood that this invention is not limited thereto and may be otherwise practiced within the scope of the following claims.

What is claimed is:

1. A table for use by at least two persons, each of whom having different needs and different physical abilities, said table comprising;

a table top oriented horizontally;

support means to support the table top on a horizontal surface and to which the table top is fixedly attached;

at least two stations situated on opposing sides of said table top, said stations being capable of independent vertical movement; and at least two connecting means, each cooperating between said table top and one of said stations, said connecting means to connect the stations to said table top and to enable said stations to be independently vertically adjusted with respect to the table top; and control means in cooperation with each of said connecting means to control the vertical adjustment of said stations;

whereby each station can be vertically adjusted by the user to accommodate his or her individual needs.

2. A table as in claim 1 wherein said connecting means further comprises at least one spring activated lift arm.

3. A table as in claim 1 further comprising tilt means in cooperation with each of the connecting means to enable the stations to tilt both forward and rearward.

4. A table as in claim 1 wherein each station has an inner edge and an outer edge and the outer edge is generally concave.

5. A table as in claim 1 wherein each station has an inner edge and an outer edge and further comprising a raised lip across the inner edge such that objects placed on the station cannot be pushed off the inner edge when the user reaches for objects on the table top.

6. A table as in claim 1 wherein the support means comprises at least two vertically oriented stanchions disposed substantially adjacent to opposing ends of the table top.

7. A table as in claim 6 further comprising at least one station adjustably affixed to one of said stanchions, and adjustment means for enabling said station to be vertically adjusted.

8. A table as in claim 1 wherein the table top is rectangular with substantially straight edges.

9. A table as in claim 1 further comprising moving means affixed to the support means at the bottom thereof for enabling the table to be easily moved from one location to another.

10. A multi-station table for use by persons having different physical requirements while enabling participation by said persons in communal activities, said table comprising:

a table top of generally polygonal shape, said table top having substantially straight side edges;

support means for supporting said table top on a horizontal surface;

a plurality of stations each having an outer edge and an inner edge;

a plurality of pivotally attached segmented connecting means each cooperating between said table top and one of said stations to connect the station to the table top and additionally to enable said station to be vertically adjusted, and control means in cooperation with each said connecting means control the vertical adjustment of said stations to allow movement of the inner edges to positions above and below one of the side edges of the table top;

whereby each person can vertically adjust the height of the station at which or she is situated in order to accommodate his or her individual requirements while participating with the other persons similarly situated in the communal activities.

11. A table as in claim 10 wherein the outer edge of each of said stations is generally concave.

12. A table as in claim 10 further comprising a raised lip across the inner edge of each of said stations such that objects placed on the station cannot be pushed off the inner edge when the user reaches for objects on the table top.

13. A table as in claim 10 further comprising tilt means in cooperation with the connecting means, said tilt means for enabling the stations to tilt both forward and rearward.

14. A table as in claim 10 wherein the pivotally attached connecting means comprise spring activated lift arms.

15. A table for use by at least two persons, each of whom having different needs and different physical disabilities, said table comprising:

a rectangular table top oriented horizontally and having two substantially straight longitudinal edges and two substantially straight transverse edges;

support means to support the table top on a horizontal surface and to which the table top is fixedly attached, said support means comprising two stanchions each disposed substantially adjacent to a transverse edge of said table top;

at least two stations situated on opposing longitudinal edges of said table top, said stations being capable of independent vertical movement to allow movement of the stations to positions above and below the table top;

at least two connecting means, each cooperating between said table top and one of said stations, said connecting means to connect the stations to the table top and to enable the stations to be independently vertically adjusted with respect to the table top; and control means in cooperation with each of said connecting means to control the vertical adjustment of said stations;

whereby each station can be vertically adjusted by the user to accommodate his or her individual needs.

16. A table as in claim 15 wherein said connecting means further comprises at least one spring activated lift arm.

17. A table as in claim 15 further comprising tilt means in cooperation with each of the connecting means to enable the stations to tilt both forward and rearward.

18. A table as in claim 15 further comprising at least one station adjustably affixed to one of said stanchions, and adjustment means for enabling said station to be vertically adjusted.

19. A table as in claim 15 wherein the stations further comprise an inner edge and an outer edge, said inner edge having a raised lip thereaccross so that objects placed on the station cannot be pushed off the inner edge when the user reaches for objects on the table top, and the outer edge is generally concave.

20. A table as in claim 15 further comprising moving means affixed to the support means at the bottom thereof for enabling the table to be easily moved from one location to another and braking means to prevent the table from being moved once it is set in place.

* * * * *